US006745707B2

(12) United States Patent
Suzuki et al.

(10) Patent No.: US 6,745,707 B2
(45) Date of Patent: Jun. 8, 2004

(54) METHOD OF DISPOSING OF COMBUSTIBLE MATERIALS

(75) Inventors: Ichiro Suzuki, Hamamatsu (JP); Shinichi Nakazawa, Shibukawa (JP); Kenji Katagiri, Tochigi-ken (JP); Hitoshi Kumata, Koriyama (JP); Hirokuni Matsuda, Hakone-machi (JP); Tokuyoshi Kawai, Tokyo (JP); Shuji Tada, Higashimatsuyama (JP)

(73) Assignees: Tokyo Electric Power Company of Tokyo (JP); Tokyo Densetsu Services Co. of Japan (JP); Prometron Technics Corporation of Tokyo (JP)

( * ) Notice: Subject to any disclaimer, the term of this patent is extended or adjusted under 35 U.S.C. 154(b) by 0 days.

(21) Appl. No.: 10/337,054

(22) Filed: Jan. 6, 2003

(65) Prior Publication Data

US 2003/0172857 A1 Sep. 18, 2003

Related U.S. Application Data

(62) Division of application No. 09/675,716, filed on Sep. 29, 2000, now Pat. No. 6,520,098.

(51) Int. Cl.[7] ..... F23B 7/00
(52) U.S. Cl. ..... 110/342; 110/208; 110/295
(58) Field of Search ..... 110/208, 209, 110/225, 229, 230, 231, 342, 295, 248, 250, 259

(56) References Cited

U.S. PATENT DOCUMENTS 1,767,952 A * 6/1930 Wollaston ..... 110/229
2,852,357 A 9/1958 Ackeron
3,046,915 A * 9/1962 Ludin ..... 110/15
3,456,604 A 7/1969 Ehrenzeller et al.
3,744,438 A 7/1973 Southwick
3,747,542 A 7/1973 Ruohola et al.
3,847,296 A 11/1974 Stockman
4,126,427 A 11/1978 Eales
4,157,896 A 6/1979 Wainer
4,343,625 A 8/1982 Gates
4,467,732 A 8/1984 Taniguchi
4,508,040 A 4/1985 Santen et al.
4,601,752 A 7/1986 Santen et al.
4,831,944 A 5/1989 Durand et al.
4,936,231 A 6/1990 Johnson
4,950,308 A 8/1990 Lang et al.
5,050,512 A 9/1991 Tratz et al.
5,054,405 A 10/1991 Walker
5,451,738 A 9/1995 Alvi et al.
5,493,578 A 2/1996 Fukusaki et al.
5,579,704 A 12/1996 Mansur
5,771,818 A 6/1998 Tada et al.
5,809,911 A 9/1998 Feizollahi
6,250,236 B1 6/2001 Feizollahi

* cited by examiner

*Primary Examiner*—Kenneth B. Rinehart
(74) *Attorney, Agent, or Firm*—Wood, Phillips, Katz, Clark & Mortimer

(57) ABSTRACT

A method of disposing of combustible materials. The method includes the steps of: providing a heating space; providing a first source to generate heat to a first predetermined level at a first location in the heating space sufficient to reconstitute the combustible materials to a molten slag at the first location and so that heat generated by the first source elevates the temperature at a second location within the heating space to a second predetermined heat level that is below the predetermined heat level and high enough to cause combustion of the combustible materials; directing combustible materials to the second location at which the combustible materials are combusted to produce ash; and causing the ash to be directed to the first location to be reconstituted as molten slag.

27 Claims, 2 Drawing Sheets

METHOD OF DISPOSING OF COMBUSTIBLE MATERIALS

CROSS REFERENCE

This application is a division of Ser. No. 09/675,716, filed Sep. 29, 2000 now U.S. Pat. No. 6,520,098, entitled "Apparatus and Method for Disposing of Dam Dirt".

BACKGROUND OF THE INVENTION

1. Field of the Invention

This invention relates to an apparatus for disposing of materials commonly accumulated at dam sites. The invention is also directed to a method of disposing of the materials using the apparatus.

2. Background Art

Disposal of unuseable materials and waste products is an ever increasing problem worldwide. One environment in which this problem is particularly acute is in the vicinity of dams, such as those at power generation facilities. Constantly flowing water carries natural and man made debris to these sites where it is accumulated. Typically, this natural material is in the form of grass, trees, branches, weeds, partially or fully decomposed organic material, etc. This material must be regularly removed from the dam sites to avoid impairing functioning of the power generating equipment.

Disposal of this type of material is difficult first by reason of its sheer volume. The material cannot be practically disposed of in high volume in open landfills or other type of waste facilities, particularly in geographical regions where space is at a premium.

Burning of the material, such as in an incinerator, while reducing its volume, often is impractical. First of all, these incinerators produce combustion byproducts that are strictly regulated in many jurisdictions. Expensive system adaptations may have to be made to comply with local emission regulations. This may lead to costs that ultimately make incineration of these materials impractical.

Another problem is that, due to the volume of these materials, a very large capacity incineration facility may be required. A considerable amount of acreage may be occupied by these facilities which may be required to be placed at locations where property costs are high.

Further, because of the emissions associated with these incinerators, proposed developers of these incinerator systems commonly meet resistance from local home and business owners. Considerable expenses may be associated with obtaining approval for building of these systems. These costs are added to the already high costs of designing and manufacturing emission controls that will meet all relevant regulatory standards.

Further, in addition to producing gaseous emission, these incinerators produce a large volume of ash resulting from the combusted materials. This ash generally has no valuable utility and is disposed of as a waste product either in landfills or other available locations. Accordingly, the operators of the systems must pay considerable sums not only to reconstitute the material and control the gaseous emissions, but also to dispose of the large volumes of resulting ash. Additionally, the ash contains dioxins, and other pollutants, in potentially large quantities which may contaminate the soil and eventually reach underground water supplies. Thus, future monitoring and regulation of the disposal of pollutants in landfills is likely to occur in countries around the world.

Accordingly, industries which must dispose of this type of material are constantly looking for fast, safe, and economical means for effecting the disposal thereof.

SUMMARY OF THE INVENTION

In one form, the invention is directed to a method of disposing of combustible materials. The method includes the steps of: providing a heating space; providing a first source to generate heat to a first predetermined level at a first location in the heating space sufficient to reconstitute the combustible materials to a molten slag at the first location and so that heat generated by the first source elevates the temperature at a second location within the heating space to a second predetermined heat level that is below the predetermined heat level and high enough to cause combustion of the combustible materials; directing combustible materials to the second location at which the combustible materials are combusted to produce ash; and causing the ash to be directed to the first location to be reconstituted as molten slag.

In one form, the first source of heat is a plasma heat source.

In one form, the second location is above the first location so that heat generated at the first location rises to heat the second location to the second predetermined heat level.

In one form, the first source of heat generates heat at the first location that rises to heat the second location to the second predetermined heat level and there is no source for generating heat at the second location to elevate the temperature at the second location to the second predetermined heat level.

In one form, the first and second locations are sub-spaces that are in at last partial vertical coincidence with each other.

The method may further include the steps of solidifying discrete amounts of the molten slag.

The method may further include the step of transporting the solidified discrete amounts of molten slag to a point of use.

The method may further include the step of changing the state of the solidified discrete amounts of molten slag for re-use.

In one form, the combusted material produces combustion gas. The method may further include the step of controllably directing the combustion gas away from the heating space to a third location and treating the combustion gas at the third location.

The combustion gas may be treated before the combustion gas is released to the atmosphere.

The combustible material may be an organic material, leaves, tree branches, tree trunks, weeds, grass, and the like.

The invention is also directed to an apparatus for disposing of combustible material. The apparatus has a wall structure bounding a heating space with a first location and a second location, and a first source of heat. The first source is capable of generating heat to a first predetermined level at the first location sufficient to reconstitute combustible materials to a molten slag at the first location and so that heat generated by the first source elevates the temperature at the second location to a second predetermined heat level that is below the first predetermined heat level and high enough to cause combustion of combustible materials.

In one form, the second location is above the first location.

The first and second locations may each be a sub-space, with the first and second sub-spaces being in at least partial vertical coincidence with each other.

The first source of heat may be a plasma heat source.

The apparatus may further include a reservoir in which molten slag generated at the first location is accumulated.

The apparatus may further include a filter for gases generated by combustion of combustible material in the heating space.

The invention is also directed to the combination of an apparatus, as described above, and combustible material in the heating space that is at least one of organic material, leaves, weeds, tree branches, tree trunks, and grass.

DETAILED DESCRIPTION OF THE DRAWINGS

Figure 1:
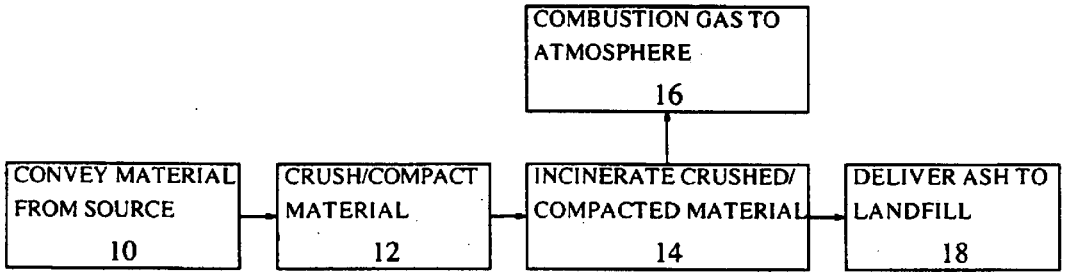
FIG.1 (PRIOR ART)
FIG. 1 is a flow chart showing one conventional method of disposing of combustible materials.

In FIG. 1, a conventional method of disposing of materials, such as organic materials, leaves, weeds, grass, branches, tree trunks, etc. is shown in flow chart form. The material to be disposed of is conveyed from a source, as shown at block 10, to an apparatus, in which the material is crushed/compacted, as shown at block 12. The crushed/compacted material is then placed in an incinerator and heated sufficiently to cause near complete combustion of the crushed/compacted material, as shown at block 14. This combustion produces two products, ash and gas. The combustion gas is discharged to the atmosphere, as shown at block 16. The ash is delivered to an appropriate disposal site, such as a landfill, as shown at block 18.

In the absence of filtering, harmful constituents may be discharged with the combustion gas to the atmosphere. Generally, the resulting ash has no practical utility and is thus disposed of without any possibility of re-use.

Figure 3:
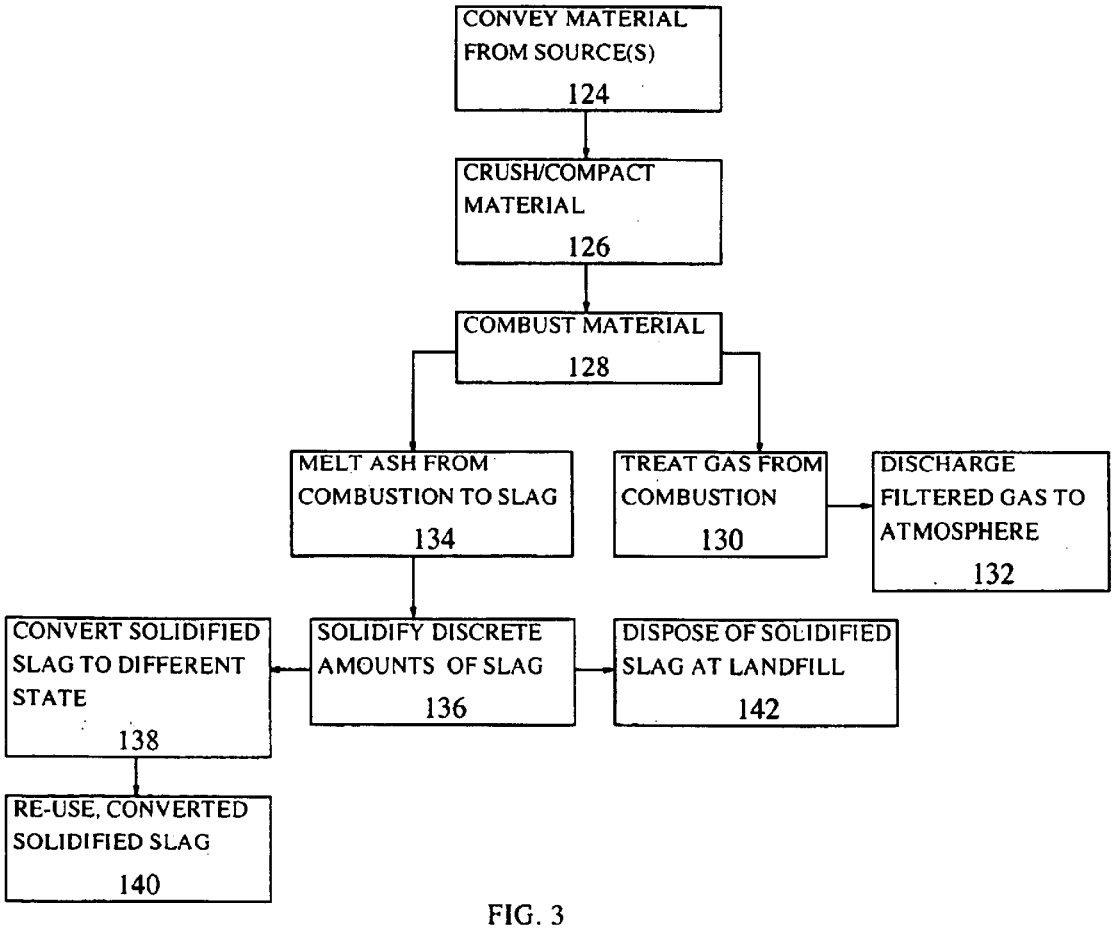
FIG. 3 is a flow chart showing the method of using the apparatus of FIG. 2 to dispose of combustible materials.
Figure 2:
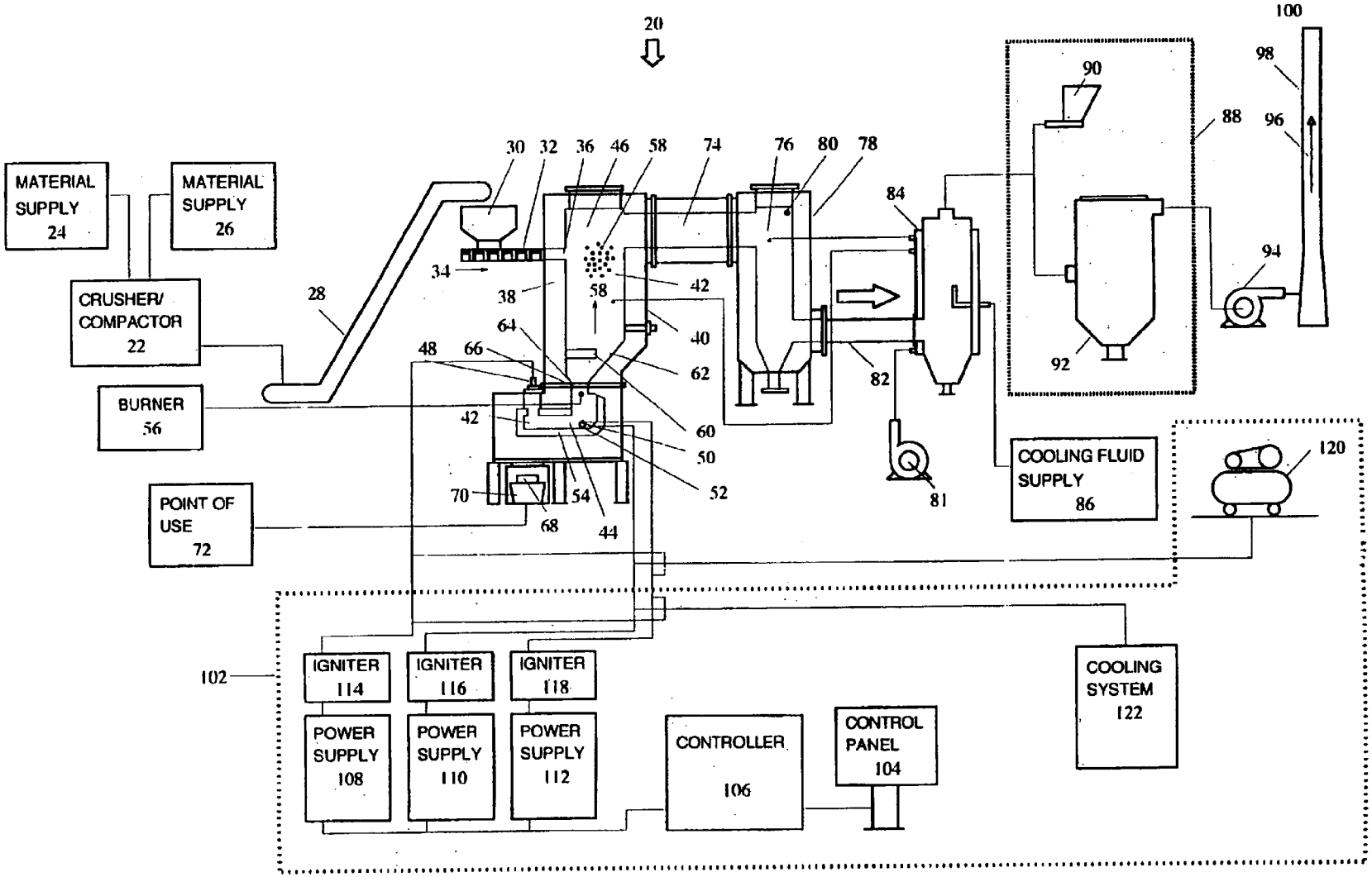
FIG. 2 is a front, partial schematic representation of an apparatus for disposing of combustible materials, according to the present invention.

Referring to FIG. 2, an apparatus for disposing of combustible material, according to the present invention, is shown at 20. FIG. 3 describes the operation of the apparatus 20 in flow diagram form.

The apparatus 20 is designed to convert materials as commonly encountered around dam sites, particularly around water intakes, as for example at a hydroelectric facility. Among these material are organic materials, leaves, grass, weeds, tree branches, tree trunks, etc. These materials may be present in an undecomposed, partially decomposed, and/or fully decomposed state.

With the apparatus 20, material may be supplied from multiple sources to a crusher/compactor 22. In this case, the material is being shown being delivered simultaneously to the crusher/compactor 22 from a first supply 24 and a second supply 26. The material from the supplies 24, 26 may be dumped directly into the crusher/compactor or continuously delivered in a stream as by a conveyor, or the like.

In the crusher/compactor, the material from the supplies 24, 26 is reduced in size and compacted to a more dense form. Once the material from the supplies 24, 26 is crushed/compacted, it is transferred to an elevating conveyor 28 and thereby delivered to a hopper 30. The hopper 30 controllably discharges the crushed/compacted material from the supplies 24, 26 to a conveyor 32. The conveyor may be a type utilizing a rotary screw to advance the material in the direction of the arrow 34 through an opening 36 in a wall 38 of a vessel 40 within which the material is heated.

More particularly, the wall 38 of the vessel 40 bounds a heating space 42 consisting of a first sub-space 44 at a first location and a second sub-space 46 at a second location which is vertically above the first location and in partial vertical coincidence therewith.

The heating space 46 is the primary treatment space within which combustion of the material from the supplies 24, 26 occurs. The heating space 46 is heated by plasma torches 48, 50, 52. In this case, three such torches 48, 50, 52 are shown. This number may change depending upon the configuration of the heating space 42, particularly the sub-space 44.

In this embodiment, the wall 38 has a surface 54 which bounds the sub-space 44 so as to define an upwardly opening accumulation trough. The heat from the plasma torches 48, 50, 52 is generated principally within the subspace 44. Suitable plasma torches 48, 50, 52 are of the type described in U.S. Pat. No. 5,771,818, the disclosure of which is incorporated herein by reference. The plasma torches 48, 50, 52 provide a source to generate heat to a predetermined level sufficient to reconstitute ash from combusted material from the supplies 24, 26 to a molten slag state. Generally this predetermined heat level is on the order of 1400° to 1500° C.

The heat generated in the sub-space 44 rises to heat the sub-space 46 thereabove so that the temperature of the sub-space 46 reaches a second predetermined level that is sufficient to cause combustion of the materials from the supplies 24, 26 in the sub-space 46. The second predetermined heat level is on the order of 400° to 800° C. Accordingly, there is no need to provide a source of heat within the sub-space 46 to cause the combustion of the materials therewithin.

A burner 56 may be operated at a location approximately at the transition between the sub-spaces 44, 46 to maintain temperature at desired levels.

In operation, the crushed/compacted material from the supplies 24, 26 is delivered through the conveyor 32 into the upper region of the sub-space 46. The temperature of the sub-space 46 is sufficient to cause pyrolysis of the material. Preferably heated air is supplied to the heating space in controlled quantities sufficient for full combustion, as a result of which the material is converted to ash 58 and partially combusted gas. This heating process is thus characterized as pyrolysis. Heavy materials that have not been combusted and converted to ash move by gravity and are intercepted by a horizontally disposed, perforate grill 60. The material supported on the grill 60 is eventually combusted and reduced to ash 58 and gas. The ash 58 migrates through the grill 60 and under its own weight is deposited in the sub-space 44. The ash 58 that is formed above the grill 60 either passes through the grill 60 or is funneled by an inclined surface 62 on the wall structure 38 into the sub-space 44. The wall structure 38 defines a horizontally spaced inclined surface 64 which diverts the ash passing through the grill 60 to the sub-space 44. The surfaces 62, 64 cooperatively produce a funnel configuration which directs the ash 58 to a restricted opening 66 between the sub-spaces 44, 46. The horizontal dimension of the opening 66, as seen in FIG. 2, is reduced by over one half a corresponding horizontal dimension of the sub-space 42 at the upper region thereof. The ash passing through the opening 66 locates in the sub-space 44. As seen in FIG. 2, there is no direct path along any vertical line between the sub-spaces 44, 46 along which materials can be directed. The downwardly moving material is intercepted either by the grill 60 or inclined surface 62.

Accordingly, the heat in the first space 44 melts the ash to form a molten pool of slag in the sub-space 44. The falling ash 58 is deposited in the pool and melts.

The pool of molten slag can be periodically discharged into containers 68 wherein the molten slag is cooled and solidified in discrete quantities. The containers 68 with the solidified slag each reside within a cart 70 which can be relocated to deliver the containers 68 to a desired point of use 72.

The partially combusted gases are delivered through a conduit 74 communicating between the heating space 42 and a secondary heating space 76 defined by a vessel 78. A burner 80 in the secondary heating space 76 elevates the temperature to on the order of 800° to 900° C. to cause perfect combustion in the heating space 76. Heated combustion air at about 400° C. is delivered as necessary to the secondary heating space 76 from a supply 81.

The gas is then delivered from the secondary heating space 76 through a conduit 82 to a cooling tower/heat exchanger 84 whereat the temperature of the gas is reduced through heat exchange with a cooling fluid from a supply 86.

From the cooling tower 84, the gas is delivered to an optional filter system 88. This filter system 88 may take a number of different forms. In the form depicted, the filter system 88 includes a lime feeder 90, to treat dioxins in the gas which is communicating from the cooling tower to the collecting vessel 92. In the collecting vessel 92, dust treatment may occur.

Gas from the vessel 92 is exhausted using a blower 94 which forces a stream of the gas in the direction of an arrow 96 through a vertical stack 98 for discharge to the atmosphere 100.

Details of the controlled operation of the plasma torches 48, 50, 52 need not be disclosed herein to fully understand the present invention. The plasma torches 48, 50, 52 are operated through a control system 102 shown generally contained within the dotted box. Generally, the control system 102 consists of: a panel 104 through which operation of the system 102 can be manually controlled and programmed; a controller 106; and power supplies 108, 110, 112 separately associated, one each with the plasma torches 48, 50, 52 and each selectively activated to operate an igniter 114, 116, 118 also associated one each with the plasma torches 48, 50, 52. Plasma air is provided by a compressor 120. The temperature of the plasma torches themselves 48, 50, 52 is controllably maintained by a cooling system 122. Reference is again made to U.S. Pat. No. 5,771,818, which describes the interaction of these components and describes additional optional components which may be used to operate the apparatus 20.

The overall operation of the apparatus 20 will now be described with reference to FIG. 3. Initially, the material from one or a plurality of supplies 24, 26 is conveyed from a source, shown at block 124 and crushed/compacted, as shown at block 126. The crushed/compacted material is then combusted in the heating space 42, as shown at block 128. The combusted material is reduced to ash and partially combusted gas. The gas from the combustion is treated by heating in the presence of air from the supply 81 in the secondary heating space 76 to be fully combusted, cooled in the tower 84, and filtered in the system 88. These steps are identified by the block 130. Filtered gas is then discharged, as through the stack 98, to the atmosphere 100, as indicated by the block 132.

The ash from combustion is melted in the heating space 42 in the subspace 44 to a molten state, as shown at block 134. The melted ash is then solidified in the container 68, as indicated at block 136. Discrete amounts of solidified slag in the containers 68 may be converted by grinding or cutting to a different state, as shown at block 138. This converted, solidified slag can then be utilized, as to make roads, or to make another type of product, as shown at block 140. Alternatively, the solidified slag can be disposed of at a landfill or other appropriate site, as indicated at block 142.

By reason of carrying out both combustion of the combustible material and melting of the combustion ash in a single space 42, a single heat source can be utilized. In this case, the heat source consists of multiple plasma torches. This obviates the need to transport the ash to a separate space for separate heating by a separate heat source. Accordingly, there is permitted an efficiency in heating that may not be achievable using separate vessels and separate heat sources to carrying out combustion and the melting of the ash.

Further, the apparatus 20 lends itself to be constructed in a compact form, particularly by reason of heating for purposes of both combustion and melting of ash in the same space. Because air is supplied to the primary heating space in an amount sufficient for complete combustion of the gases produced from heating the material, the volume capacity of the heating space can be minimized. Further by reason of using plasma torches for a heat source, oxygen requirements can be substantially reduced which thereby makes possible the minimization of the volume of the space 42 within which heating occurs.

Additionally, the use of plasma torches obviates the need to use heating fuels that may themselves produce byproducts that can have problems associated with their discharge to the atmosphere.

Additionally, by reason of reducing the ash to a useable form, the converted ash can be recycled. This potentially avoids the detrimental accumulation of ash in landfills, and like areas.

A system made according to the present invention may have a high volume capability, such as on the order of 200 kg/h, for the materials described above.

The foregoing disclosure of specific embodiments is intended to be illustrative of the broad concepts comprehended by the invention.

What is claimed is:

1. A method of disposing of materials that are combustible to produce ash, said method comprising the steps of:

providing a heating space;

providing a first source to generate heat to a first predetermined level at a first location in the heating space sufficient to reconstitute ash resulting from combustion of the combustible materials to a molten slag at the first location and so that heat generated by the first source elevates the temperature at a second location within the heating space to a second predetermined heat level that is below the first predetermined heat level and high enough to cause combustion of the combustible materials;

directing the combustible materials to the second location at which the combustible materials are combusted to produce ash;

continously causing the ash to be directed by gravitational force from the second location to the first location to be reconstituted as molten slag; and intercepting combustible material mixed with the ash that has not been combusted at the second location to allow combustion thereof before being directed to the first location while allowing ash to move from the second location to the first location.

2. The method of disposing of combustible materials according to claim 1 wherein the first source of heat comprises a plasma heat source.

3. The method of disposing of combustible materials according to claim 1 wherein the second location is above the first location so that heat generated at the first location rises to heat the second location to the second predetermined heat level.

4. The method of disposing of combustible materials according to claim 1 wherein the first source of heat generates heat at the first location that rises to heat the second location to the second predetermined heat level and there is no source for generating heat at the second location to elevate the temperature at the second location to the second predetermined heat level.

5. The method of disposing of combustible materials according to claim 1 wherein the first and second locations comprise sub-spaces that are in at least partial vertical coincidence with each other.

6. The method of disposing of combustible materials according to claim 1 further comprising the steps of solidifying discrete amounts of the molten slag.

7. The method of disposing of combustible materials according to claim 6 including the step of transporting the solidified discrete amounts of molten slag to a point of use.

8. The method of disposing of combustible materials according to claim 7 including the step of changing the state of the solidified discrete amounts of molten slag for re-use.

9. The method of disposing of combustible materials according to claim 1 wherein the combusted material produces combustion gas and further including the steps of controllably directing the combustion gas away from the heating space to a third location and treating the combustion gas at the third location.

10. The method of disposing of combustible materials according to claim 1 wherein the combusted material produces combustion gas and further including the step of treating the combustion gas before the combustion gas is released to the atmosphere.

11. The method of disposing of combustible materials according to claim 1 wherein the combustible material comprises at least one of a) leaves, b) tree branches, c) tree trunks, d) grass, and e) weeds.

12. The method of disposing of combustible materials according to claim 1 wherein the combustible material comprises organic material.

13. The method of disposing of combustible materials according to claim 1 wherein the step of intercepting combustible material comprises intercepting combustible material by a grill projecting into the heating space.

14. A method of disposing of materials that are combustible to produce ash, said method comprising the steps of:

providing a heating space;

providing a first source to generate heat to a first predetermined level at a first location in the heating space sufficient to reconstitute ash resulting from combustion of the combustible materials to a molten slag at the first location and so that heat generated by the first source elevates the temperature at a second location within the heating space to a second predetermined heat level that is below the first predetermined heat level and high enough to cause combustion of the combustible materials;

directing the combustible materials from an inlet in a vertical path by gravitational forces to the second location at which the combustible materials are combusted to produce ash;

continuously moving the ash in the vertical path through a restricted opening to the first location; and causing the ash directed to the first location to be reconstituted as molten slag, whereby combustible material and thereafter ash produced therefrom can move continuously in the vertical path from the inlet to the first location.

15. The method of disposing of materials according to claim 14 wherein the first source of heat comprises a plasma heat source.

16. The method of disposing of combustible materials according to claim 14 wherein the second location is above the first location so that heat generated at the first location rises to heat the second location to the second predetermined heat level.

17. The method of disposing of combustible materials according to claim 14 wherein the first source of heat generates heat at the first location that rises to heat the second location to the second predetermined heat level and there is no source for generating heat at the second location to elevate the temperature at the second location to the second predetermined heat level.

18. The method of disposing of combustible materials according to claim 14 wherein the first and second locations comprise sub-spaces that are in at least partial vertical coincidence with each other.

19. The method of disposing of combustible materials according to claim 14 wherein the combustible material comprises at least one of a) leaves, b) tree branches, c) tree trunks, d) grass, and e) weeds.

20. A method of disposing of materials that are combustible to produce ash, said method comprising the steps of:

providing a heating space;

providing a first source to generate heat to a first predetermined level at a first location in the heating space sufficient to reconstitute ash resulting from combustion of the combustible materials to a molten slag at the first location and so that heat generated by the first source elevates the temperature at a second location within the heating space to a second predetermined heat level that is below the first predetermined heat level and high enough to cause combustion of the combustible materials;

directing the combustible materials to the second location at which the combustible materials are combusted to produce ash;

causing the ash to be directed by gravitational forces directly along a straight vertical path from the second location to the first location to be reconstituted as molten slag; and causing vertically moving uncombusted material mixed with ash moving in the vertical path to be intercepted in moving from the second location to the first location while allowing the ash mixed with the uncombusted materials to continue moving in the vertical path to the first location.

21. The method of disposing of combustible materials according to claim 20 wherein the first source of heat comprises a plasma heat source.

22. The method of disposing of combustible materials according to claim 20 wherein the second location is above the first location so that heat generated at the first location rises to heat the second location to the second predetermined heat level.

23. The method of disposing of combustible materials according to claim 20 wherein the first source of heat generates heat at the first location that rises to heat the second location to the second predetermined heat level and there is no source for generating heat at the second location to elevate the temperature at the second location to the second predetermined heat level.

24. The method of disposing of combustible materials according to claim 20 wherein the first and second locations comprise sub-spaces that are in at least partial vertical coincidence with each other.

25. The method of disposing of combustible materials according to claim 20 wherein the combustible material comprises at least one of a) leaves, b) tree branches, c) tree trunks, d) grass, and e) weeds.

26. A method of disposing of combustible materials, said method comprising the steps of:

providing a heating space;

providing a first source to generate heat to a first predetermined level at a first location in the heating space sufficient to reconstitute the combustible materials to a molten slag at the first location and so that heat generated by the first source elevates the temperature at a second location within the heating space to a second predetermined heat level that is below the first predetermined heat level and high enough to cause combustion of the combustible materials;

directing the combustible materials to the second location at which the combustible materials are combusted to produce ash; and causing the ash to be continuously moved and directed by gravitational forces from the second location to the first location to be reconstituted as molten slag.

27. The method of disposing of combustible materials according to claim 26 wherein the combustible material comprises at least one of a) leaves, b) tree branches, c) tree trunks, d) grass, and e) weeds.

* * * * *